US009765790B2

(12) United States Patent
Tanner et al.

(10) Patent No.: US 9,765,790 B2
(45) Date of Patent: Sep. 19, 2017

(54) TANDEM THRUST BEARING WITH RESILIENT BEARING SUPPORT

(71) Applicant: Baker Hughes Incorporated, Houston, TX (US)

(72) Inventors: David Tanner, Broken Arrow, OK (US); Arturo Luis Poretti, Claremore, OK (US); Ryan P. Semple, Owasso, OK (US); Aron M. Meyer, Pryor, OK (US)

(73) Assignee: Baker Hughes Incorporated, Houston, TX (US)

( * ) Notice: Subject to any disclaimer, the term of this patent is extended or adjusted under 35 U.S.C. 154(b) by 331 days.

(21) Appl. No.: 14/660,618

(22) Filed: Mar. 17, 2015

(65) Prior Publication Data

US 2015/0354582 A1 Dec. 10, 2015

Related U.S. Application Data

(60) Provisional application No. 62/008,876, filed on Jun. 6, 2014.

(51) Int. Cl.

| | |
|---|---|
| ***F04D 13/08*** | (2006.01) |
| ***F04D 29/041*** | (2006.01) |
| ***F04C 2/107*** | (2006.01) |
| ***F04C 13/00*** | (2006.01) |
| ***F04C 15/00*** | (2006.01) |

(Continued)

(52) U.S. Cl.

CPC ..... *F04D 29/0413* (2013.01); *F04C 2/107* (2013.01); *F04C 13/008* (2013.01); *F04C 15/008* (2013.01); *F04D 1/00* (2013.01); *F04D 7/04* (2013.01); *F04D 13/06* (2013.01); *F04D 13/08* (2013.01); *F04D 29/043* (2013.01); *F04D 29/426* (2013.01); *F04D 29/445* (2013.01);

(Continued)

(58) Field of Classification Search

CPC .... F04C 13/008; F04C 15/0042; F01D 25/16; F04D 13/086; F04D 29/0413; F04D 29/426; F16C 17/10

See application file for complete search history.

(56) References Cited

U.S. PATENT DOCUMENTS 4,240,683 A 12/1980 Crasse
4,884,899 A * 12/1989 Schwartzman ..... F16C 17/10 384/100

(Continued)

*Primary Examiner* — Patrick Hamo

(74) *Attorney, Agent, or Firm* — Bracewell LLP; James E. Bradley

(57) ABSTRACT

An electrical submersible pump assembly has a thrust bearing mechanism with first and second thrust runners axially and rotationally secured to the shaft and located within a housing. First and second thrust receiving structures are rigidly mounted in the housing to receive thrust from the first and second thrust transferring devices. A deflectable member located in the first thrust transfer thrust device decreases in axial thickness in response to thrust of a selected level. The second thrust transfer thrust device has an axial length less than an axial distance from the second thrust receiving structure to the second thrust runner, defining an initial axial gap. During operation of the pump, the shaft and the first and second thrust runners move axially a limited extent, closing the gap and transferring thrust from the second thrust transfer device to the second thrust receiving structure.

18 Claims, 3 Drawing Sheets

(51) Int. Cl.

| | |
|---|---|
| ***F04D 1/00*** | (2006.01) |
| ***F04D 7/04*** | (2006.01) |
| ***F04D 13/06*** | (2006.01) |
| ***F04D 29/043*** | (2006.01) |
| ***F04D 29/42*** | (2006.01) |
| ***F04D 29/44*** | (2006.01) |

(52) U.S. Cl.
CPC ..... *F04C 2/1071* (2013.01); *F04C 15/0042* (2013.01)

(56) References Cited

U.S. PATENT DOCUMENTS 5,697,768 A * 12/1997 Mills ..... E21B 17/1007 166/117.7
6,091,175 A * 7/2000 Kinsinger ..... F16C 17/22 277/438
7,987,913 B2 * 8/2011 Parmeter ..... E21B 43/128 166/107

* cited by examiner

TANDEM THRUST BEARING WITH RESILIENT BEARING SUPPORT

CROSS REFERENCE TO RELATED APPLICATION

This application claims priority to provisional application 62/008,876, filed Jun. 6, 2014.

FIELD OF THE DISCLOSURE

This disclosure relates in general to submersible well pump assemblies and in particular to a tandem thrust bearing with a resilient bearing support.

BACKGROUND

Electrical submersible pumps (ESP) are commonly used to pump oil and water from hydrocarbon wells. A typical ESP has a pump coupled to a motor and driven by a shaft rotated by the motor. The pump, which is often a centrifugal pump with a large number of stages, creates down thrust on the shaft. The ESP has a thrust bearing to transfer down thrust on the shaft to the housing. The thrust bearing includes a thrust runner rigidly mounted to the shaft and a thrust pad or base that is rotationally engaged by the thrust runner. The thrust pad receives thrust from the thrust runner and transfers the thrust to a housing of the ESP.

In some instances, the thrust can be very large. Because the diameter of the ESP is restricted, tandem thrust bearings may be employed to accommodate larger thrust. Tandem thrust bearings include upper and lower thrust runners rigidly mounted to the shaft. The upper thrust runner transfers a portion of the thrust from the shaft to an upper bearing pad. The lower thrust runner transfers another portion of the thrust from the shaft to a lower bearing pad.

One difficulty occurs in sharing the amount of thrust transferred by the upper and lower thrust runners. Because of tolerances and thermal growth of the shaft relative to the housing, it is difficult to achieve a desired amount of load sharing. Various proposals have been made to share the load between tandem thrust bearings.

SUMMARY

An electrical submersible pump assembly includes a pump, a motor operatively coupled to the pump, and a shaft extending along an axis from the motor into the pump for driving the pump. The pump assembly has a thrust bearing mechanism that include first and second thrust runners axially and rotationally secured to the shaft and located within a housing. First and second thrust transferring devices are non rotatably mounted in the housing and axially movable a limited extent relative to the housing. First and second thrust receiving structures are rigidly mounted in the housing for receiving thrust from the first and second thrust transferring devices, respectively, and transferring the thrust to the housing. A deflectable member located in the first thrust transfer device decreases in axial thickness in response to thrust of a selected level passing through the first thrust transfer device. The second thrust transfer thrust device has an axial length less than an axial distance from the second thrust receiving structure to the second thrust runner while the pump is not operating, defining an initial axial gap. During operation of the pump, the shaft and the first and second thrust runners move axially a limited extent, closing the gap and transferring thrust from the second thrust transfer device to the second thrust receiving structure.

The gap, while in existence, prevents any thrust from being transferred through the second thrust transferring device. The gap closes in response to thrust of a selected magnitude. Preferably, the gap is an annular empty space.

In the preferred embodiment, the deflectable member is resilient. The deflectable member comprises a disc of a resiliently deformable material. The deformable material may be graphite or polytetrafluoroethylene (PTFE).

In the embodiment shown, the first thrust receiving structure is located above the second thrust runner. The housing comprises a first housing section and a second housing section. The first thrust receiving device comprises a threaded first connector member that rigidly secures the first housing section and the second housing section to each other. The first thrust transferring device comprises a first bearing pad and a first thrust transferring member. The first thrust transferring member has a first thrust shoulder on a first end and a second end that abuts the first connector member. The first thrust transferring member is capable of limited axial movement relative to the first connector member. The deflectable member is located between the first thrust shoulder and the first bearing pad.

Also, in the embodiment shown, the second thrust transferring device comprises a threaded second connector member rigidly secured by threads to a second end of the second housing section. The second thrust transferring device comprises a second bearing pad and a second thrust transferring member. The second thrust transferring member has a second thrust shoulder on a first end and a second end that abuts the second connector member. The second thrust transferring member is capable of limited axial movement relative to the second connector member.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
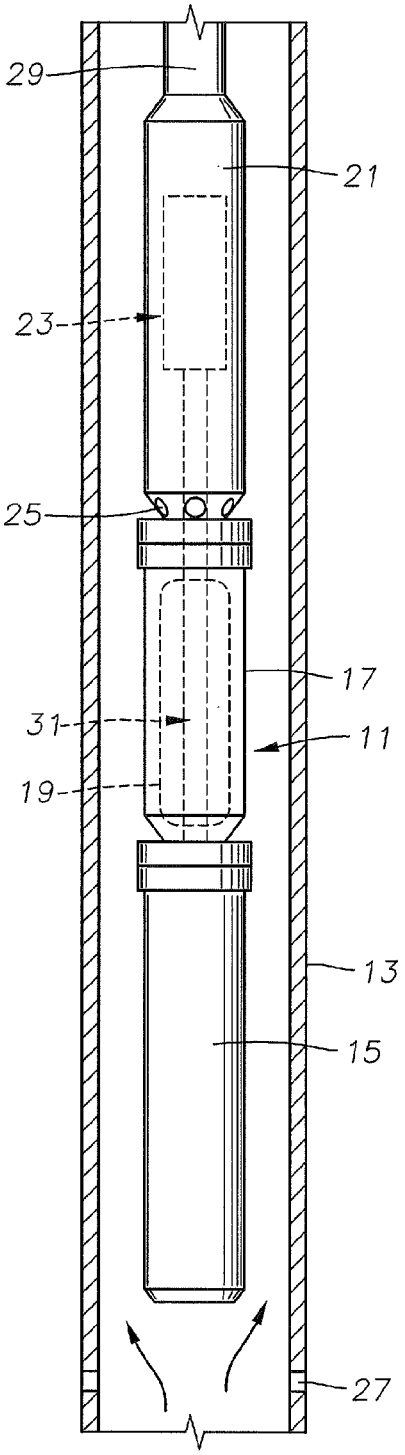
FIG. 1 is a side view of an electrical submersible pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows an electrical submersible pump (ESP) 11 suspended in a cased well 13. ESP 11 typically includes an electrical motor 15. Motor 15 is normally a three-phase AC motor and may be connected in tandem to other motors. A seal section or pressure equalizer 17 is illustrated at an upper end of motor 13. Alternately, pressure equalizer 17 could be mounted below motor 13. Although shown vertically suspended, ESP 11 may be installed within inclined or horizontal portions of a well. Thus the terms "upper" and "lower" are used only for convenience and not in a limiting manner. Pressure equalizer 17 has features, such as a bag or bellows 19, to reduce a pressure differential between a dielectric motor lubricant in motor 15 and the exterior well fluid hydrostatic pressure.

A pump 21 connects to the upper end of pressure equalizer 17 in this example. Pump 21 could be a centrifugal pump with a large number of stages 23, each stage having an impeller and a diffuser. Alternately, pump 21 could be another type, such as a progressing cavity pump. Pump 21 has an intake 25 for admitting well fluid from casing perforations 27 or other openings. A gas separator (not shown) could be mounted below pump 21, and if so intake 25 would be in the gas separator. A string of production tubing 29 secures to the upper end of pump 21 and supports ESP 11 in well 13. Production tubing string 29 may comprise sections of tubing with threaded ends secured together, or it could be continuous coiled tubing. In this illustration, pump 21 discharges through tubing 29 to a wellhead (not shown) at the upper end of well 13. A shaft 31 extends from within motor 15 through pump 21 for driving pump 21. Shaft 31 normally comprises separate sections of a shaft within motor 15, pressure equalizer 17 and pump 21 coupled together with splined couplings.

Figure 2:
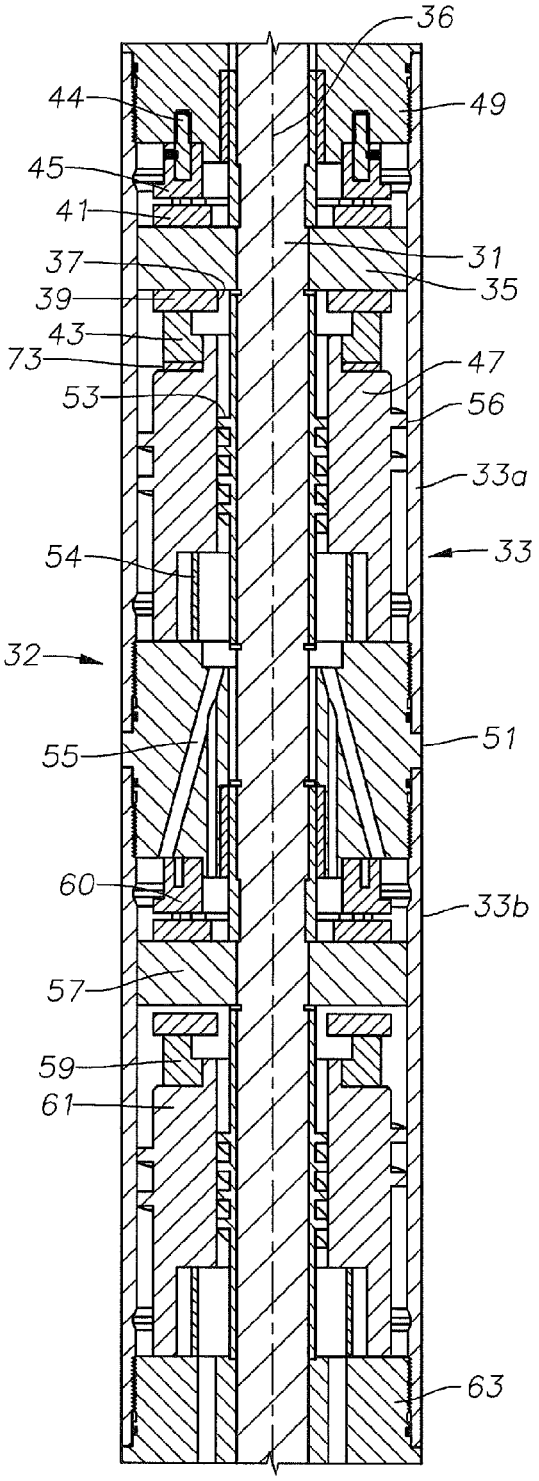
FIG. 2 is a sectional view of tandem thrust bearing of the pump assembly of FIG. 1.

FIG. 2 illustrates a thrust bearing unit 32 that forms a part of ESP 11. Thrust bearing unit 32 may be located at various places within ESP 11, such as within pressure equalizer 17, within motor 15, or as a separate module mounted between pressure equalizer 17 and motor 15. Thrust bearing unit 32 has a tubular housing 33 that may be formed in two sections, 33*a*, 33*b*. Housing 33 could be part of the housing of pressure equalizer 17 or motor 15, or it could be a separate housing.

Thrust bearing unit 32 is a tandem thrust bearing assembly, having an upper thrust runner 35 secured to shaft 31 so as to rotate with shaft 31 and also be fixed axially relative to shaft 31. The connection of thrust runner 35 to shaft 31 may include a retainer ring 37. Thrust runner 35 has a flat lower side that transfers down thrust from shaft 31 to non rotating bearing pads 39. Upper thrust runner 35 has a flat upper side portion for transferring up thrust from shaft 31 to non rotating up thrust bearing pads 41. Down thrust bearing pads 39 are mounted to a non rotating down thrust base 43, which may be considered to be a part of down thrust bearing pads 39. Up thrust bearing pads 41 are mounted to a non rotating up thrust base 45, which may be considered to be a part of up thrust bearing pads 41. Each thrust base 43, 45 is an annular member through which shaft 31 passes.

Upper down thrust base 43 transfers down thrust to an upper down thrust transferring member 47, which is a tubular member mounted in upper housing 33*a*. Up thrust base 45 transfers up thrust to an upper up thrust receiving member, which in this embodiment, comprises an upper threaded connector or guide 49 for connecting upper housing 33*a* to an ESP module above. In this example, pins (not shown) extend between down thrust base 43 and down thrust transferring member 47 to prevent rotation but allow axial movement of down thrust base 43 relative to down thrust transferring member 47. Similarly, pins 44 extend between up thrust base 45 and upper guide 49 to prevent rotation of up thrust base 45.

Down thrust transferring member 47 is mounted so as to be non rotatable but optionally may be capable of limited axial movement in housing 33*a*. In this example, down thrust transferring member 47 transfers down thrust to a thrust receiving member, which comprises a central threaded guide 51 that rigidly connects upper and lower housing sections 33*a*, 33*b*. Pins (not shown) extend between down thrust transferring member 47 and central guide 51 to prevent rotation of down thrust transferring member 47. Down thrust transferring member 47 could be a part of and integrally formed with central guide 51. Alternately, down thrust transferring member 47 could be a part of and integrally formed with down thrust base 43. The assembly of upper bearing pads 39, upper down thrust base 43 and upper down thrust transferring member 47 may be considered to be an upper down thrust transferring device.

A lubricant inducer pump 53 optionally may be mounted to shaft 31 for rotation therewith within a central bore of down thrust transferring member 47. Lubricant passages 55 may extend through central guide 51 to allow the upward flow of lubricant, which is normally lubricant contained in motor 15 (FIG. 1). A mesh screen filter 54 optionally mounts in a lower counterbore of down thrust transferring member 47 to filter debris from oil being circulated by inducer pump 53. An annular space between the outer diameter of down thrust transferring member 47 and the inner diameter of upper housing section 33*a* provides a passage for the return or downward flow of motor lubricant. Fins 56 on the exterior of down thrust transferring member 47 assist in heat exchange with the lubricant.

Figure 3A:
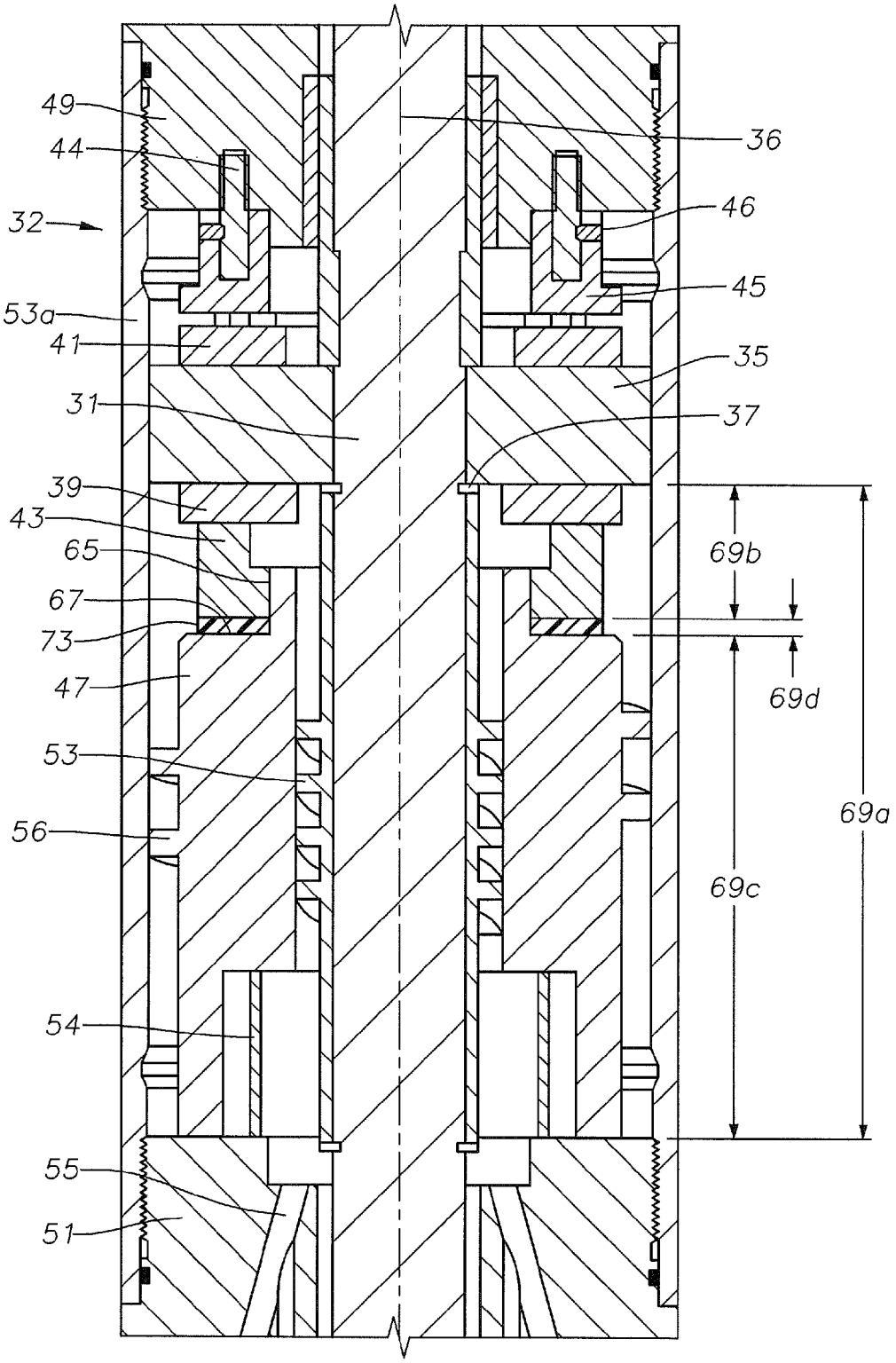
FIGS. 3*a* and 3*b* comprise an enlarged sectional view of a portion of the tandem thrust bearing of FIG. 2.
Figure 3B:
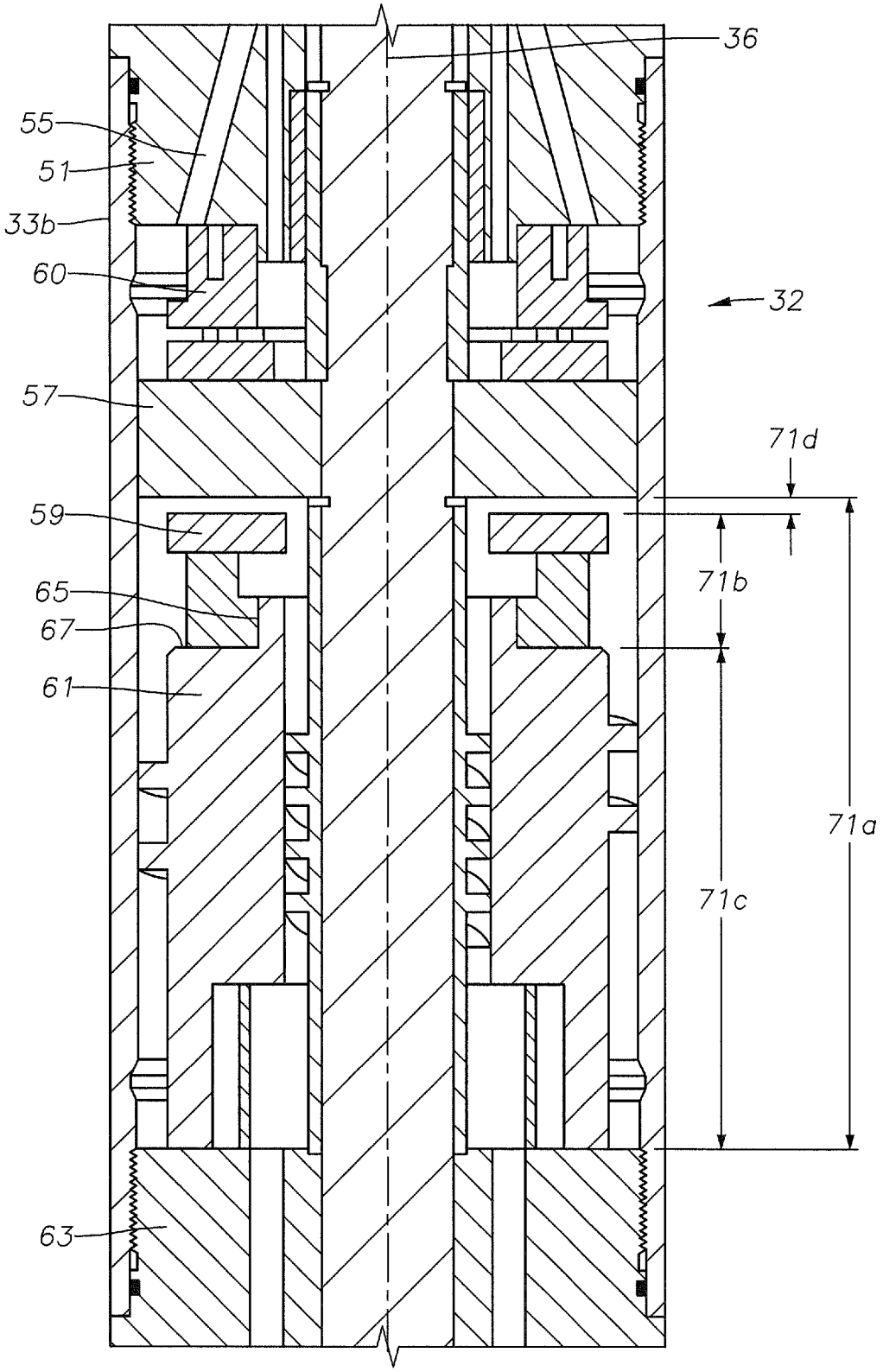

Referring to FIG. 3B, a lower thrust runner 57 below central guide 51 couples to shaft 31 for rotation and axial movement therewith. Lower thrust runner 57 transfers down thrust to a non rotating lower down thrust pads 59, which may have a base the same as upper base 43. Lower thrust runner 57 may transfer up thrust to non rotating lower up thrust pads 60. Lower down thrust base 59 transfers down thrust to a lower down thrust transferring member 61, which in turn bears against a lower down thrust receiving device that comprises a threaded guide 63 secured to the lower end of lower housing 33*b*. Lower up thrust base 60 transfers up thrust to central guide 51. Lower thrust runner 57, lower down thrust base 59, lower up thrust base 60, and lower down thrust transferring member 61 may have the same construction and features as upper thrust runner 35, upper down thrust base 43, upper up thrust base 45, and upper down thrust transferring member 47, respectively. Lower down thrust base 59 and lower down thrust transferring member 61 may be considered to be a lower down thrust transferring device.

Referring to FIG. 3A, in one embodiment, upper down thrust transferring member 47 has a tubular neck 65, which defines an annular upward-facing shoulder 67. Upon initial assembly, upper up thrust base 45 is fixed axially to upper guide 49 and housing 33 with set screws 46 that engage pins 44 at a desired point. The up and down movement of runner 35 and shaft 31 relative to housing 33 is thus established by adjusting the axial position of upper up thrust base 45 with set screws 46 and pins 44. Prior to operation, a fixed axial distance 69*a* extends from the upper end of central guide 51 to upper thrust runner 35. The sum of an axial dimension 69*b* of upper down thrust base 43 (including pads 39) plus the axial dimension 69*c* from the lower end of upper down thrust transferring member 47 to shoulder 67 is less than axial dimension 69*a*, resulting in a difference or gap 69*d*.

In this embodiment, upper down thrust transferring member 47 and upper down thrust base 43 are not fixed axially to either shaft 31 or housing 33. Alternatively, upper down thrust transferring member 47 could be fixed axially to central guide 51, in which case only upper down thrust base 43 is axially movable relative to housing 33. As another alternative, upper down thrust transferring member 47 could be rigidly secured to upper down thrust base 43; in that case, both move axially in unison relative to housing 33, and gap 69*d* would be located between the lower end upper down thrust transferring member 47 and central guide 51.

Similarly, as shown in FIG. 3B, lower down thrust support 59 has a tubular neck 65, which defines an annular upward-facing shoulder 67. Prior to operation, a fixed axial distance 71*a* extends from the upper end of lower guide 63 to the lower side of lower thrust runner 57. The sum of axial dimension 71*b* of lower down thrust base 59 (including its pads) plus the axial dimension 71*c* from the lower end of lower down thrust transferring member 61 to its shoulder 67 is less than axial distance 71*a* by amount equal to gap 71*d*. Gap 71*d* is shown to be between lower down thrust runner base 59 and the lower side of lower thrust runner 57. Alternatively, gap 71*d* could be between shoulder 67 and the lower side of lower down thrust base 59.

In this embodiment, lower down thrust transferring member 61 and lower down thrust bearing base 59 are both axially movable in housing 33. Alternatively, lower down thrust transferring member 61 could be fixed axially to lower guide 63, in which case only lower down thrust base 59 is axially movable relative to housing 33. As another alternative, lower down thrust transferring member 61 could be rigidly secured to lower down thrust base 59; in that case, both would be axially movable in unison relative to housing 33, and gap 71*d* would be between the lower end of lower down thrust transferring member 61 and lower guide 63.

Upper gap 69*d* is illustrated as being between shoulder 67 of upper down thrust transferring member 47 and upper down thrust base 43. However, even if upper down thrust base 43 and upper down thrust transferring member 47 are independently axially movable relative to housing 33, as shown, gap 69*d* could be between upper down thrust transferring member 47 and central guide 51. Similarly, lower gap 71*d* could be between lower down thrust transferring member 61 and lower guide 63. Gaps 69*d*, 71*d* need not have the same axial dimension. Gaps 69*d*, 71*d* are preferably located between two static or non rotating surfaces that transmit thrust.

In one embodiment, a resilient disc 73 is placed in only one of the gaps 69*d*, 71*d* prior to operation. In the embodiment shown, disc 73 is located in the upper gap 69*d*. Disc 73 may have a thickness equal to the gap in which it is located. Disc 73 is of a deformable material of high compressive strength, so that even high down thrust will pass through it without excessive extrusion. The deformable material is preferably resilient, causing disc 73 to axially deflect while undergoing down thrust of a selected level. For example, the material of disc 73 may be a flexible graphite material, such as Grafoil, or glass-filled polytetrafluoroethylene (PTFE). The material may be metal reinforced.

During operation, with disc 73 only in the upper gap 69*d*, upper thrust runner 35 and upper down thrust base 43 are considered to be the first or primary bearing. As the down thrust is initially transmitted through disc 73 to central guide 51, disc 73 deflects, allowing shaft 31 and thrust runners 35, 57 to move downward and decreasing the axial dimension of lower gap 71*d*. In one embodiment, at a selected level of down thrust, the deflection causes lower gap 71 to completely close. At this point, any extra down thrust is transferred through lower down thrust base 59 and lower down thrust transferring member 61 to lower guide 63. This transferal effectively limits the amount of thrust that is transferred through upper down thrust base 43.

Alternately, disc 73 may be installed only in lower gap 71*d*. In that instance, lower thrust runner 57 and lower down thrust base 59 will be considered to be the primary or first thrust bearing. The deflection of disc 73 would operate in the same manner as described above, transferring a share of the down thrust to the upper thrust runner 35 and upper down thrust base 43.

Thermal growth can increase the length of shaft 31 relative to housing 33, thus changing the dimensions 69*a* and 71*a*. The resiliency of disc 73 accommodates this change in dimension, maintaining a sharing of down thrust between the upper and lower thrust bearings.

In another alternative embodiment, the components may be sized to cause down thrust to be transferred through lower down thrust transferring member 61 only after sufficient wear has occurred between upper thrust runner 35 and down thrust bearing pads 39 of upper down thrust base 43. As in the first embodiment, disc 73 could be only in upper gap 69*d*, with lower gap 71*d* open initially. In still another alternative, discs 73 could be placed in both gaps 69*d* and 71*d*. Both discs 73 would deflect, and load sharing would occur as the primary bearing wears.

The resiliency of disc 73 causes the thickness of disc 73 to increase when the down thrust decreases and when pump 21 is turned off. Gaps and resilient material discs are not shown for the up thrust bases 45 and 60, but they could be similarly constructed.

While the disclosure has been described in only a few of its forms, it should be apparent to those skilled in the art that various changes may be made.

The invention claimed is:

1. An electrical submersible pump assembly, comprising:

a pump;

a motor operatively coupled to the pump;

a shaft extending along an axis from the motor into the pump for driving the pump;

a thrust bearing mechanism, comprising:

a housing;

first and second thrust runners axially and rotationally secured to the shaft;

first and second thrust transferring devices non rotatably mounted in the housing and axially movable a limited extent relative to the housing;

first and second thrust receiving structures rigidly mounted in the housing for receiving thrust from the first and second thrust transferring devices, respectively, and transferring the thrust to the housing;

the first thrust transferring device being axially between the first thrust runner and the first thrust receiving structure;

the first receiving structure being axially between the first thrust transferring device and the second thrust runner;

the second thrust transferring device being axially between the second thrust runner and the second thrust receiving structure;

a deflectable member in engagement with the first thrust transferring device that decreases in axial thickness in response to thrust of a selected level passing through the deflectable member and the first thrust transferring device to the first thrust receiving structure;

the second thrust transferring device having an axial length less than an initial axial distance from the second thrust receiving structure to the second thrust runner while the pump is not operating, defining an initial axial gap; and wherein during operation of the pump, the shaft and the first and second thrust runners move axially a limited extent in unison in response to deflection of the deflectable member, decreasing the initial axial distance, closing the gap and transferring thrust from the second thrust transferring device to the second thrust receiving structure.

2. The assembly according to claim 1, wherein:

the gap, while in existence, prevents any thrust from being transferred through the second thrust transferring device to the second thrust receiving device.

3. The assembly according to claim 1, wherein:

the gap closes in response to thrust of a selected magnitude.

4. The assembly according to claim 1, wherein:

the gap is an annular empty space.

5. The assembly according to claim 1, wherein:

the deflectable member comprises a disc of a resiliently deformable material.

6. The assembly according to claim 1, wherein:

the deflectable member is formed of a material selected from one of the following:

graphite and PTFE.

7. The assembly according to claim 1, wherein:

the housing comprises a first housing section and a second housing section;

the first thrust receiving device comprises a threaded first connector member, the first connector member rigidly securing the first housing section and the second housing section to each other;

the first thrust transferring device comprises a first bearing pad; and the deflectable member is located axially between the first bearing pad and the first threaded connector member.

8. The assembly according to claim 1, wherein:

the housing comprises a first housing section and a second housing section;

the first thrust receiving device comprises a threaded first connector member, the first connector member rigidly securing the first housing section and the second housing section to each other;

the first thrust transferring device comprises a first bearing pad that is engaged by the first thrust runner and a first thrust transferring member located axially between the first bearing pad and the first connector member;

the first thrust transferring member has a first end and a second end; and the deflectable member is in abutment with one of the ends of the first thrust transferring member.

9. The assembly according to claim 8, wherein:

the second thrust transferring device comprises a threaded second connector member rigidly secured by threads to a second end of the second housing section;

the second thrust transferring device comprises a second bearing pad for engagement by the second thrust runner and a second thrust transferring member located between the second bearing pad and the second connector member; and the second thrust transferring member has a first end and a second end that abuts the second connector member; and the initial gap is located between the first end of the second thrust transferring member and the second bearing pad.

10. An electrical submersible pump assembly, comprising:

a pump;

a motor operatively coupled to the pump;

a shaft extending along an axis from the motor into the pump for driving the pump;

a thrust bearing mechanism, comprising:

a housing, the shaft extending through the housing and being capable of limited axial movement relative to the housing;

first and second thrust runners axially spaced apart from each other and axially and rotationally secured to the shaft within the housing;

axially spaced apart first and second thrust receiving structures rigidly mounted in the housing;

first and second bearing pads non rotatably mounted in the housing adjacent the first and second thrust runners, respectively, the first and second bearing pads being capable of limited axial movement relative to the housing;

a first thrust transferring member located between the first thrust receiving structure and the first bearing pad, the first bearing pad being located between the first transferring member and the first thrust runner;

a second thrust transferring member between the second thrust receiving structure and the second bearing pad, the second bearing pad being located between the second thrust transferring member and the second thrust runner, the second thrust transferring member and the second bearing pad having prior to operation of the pump a combined axial length less than a distance from the second thrust receiving member to the second thrust runner, defining an axial initial gap;

a disc of deflectable material located axially between the first bearing pad and the first thrust receiving structure for transferring thrust from the first bearing pad through the disc and the first thrust transferring member to the first thrust receiving structure; wherein a thrust of a selected minimum causes the disc to decrease in thickness, allowing the shaft and the first and second thrust runners to move axially in unison relative to the housing; and the gap is sized to close upon sufficient axial movement of the second thrust runner toward the second bearing pad, thereby transferring thrust also to the second thrust receiving structure.

11. The assembly according to claim 10, wherein:

the gap is an annular empty space.

12. The assembly according to claim 10, wherein:

the disc is resilient such that ceasing operation of the pump after the disc has been deflected causes the disc to increase in thickness.

13. The assembly according to claim 10, wherein:

the deflectable material comprises one of the following: graphite and PTFE.

14. The assembly according to claim 10, wherein:

the disc is located axially between the first bearing pad and the first thrust transferring member.

15. The assembly according to claim 14, wherein:

prior to operation of the pump, a cumulative axial length of the first bearing pad, the disc, and the first thrust transferring member is greater than a cumulative axial length of the second bearing pad and the second thrust transferring member.

16. The assembly according to claim 10, wherein:

the first thrust transferring member has a first neck and a first thrust shoulder surrounding the first neck;

the first bearing pad has a base portion that fits around and is axially slidable on the first neck;

the disc is located between the base portion of the first bearing pad and the first thrust shoulder;

the second thrust transferring member has a second neck and a second thrust shoulder surrounding the second neck;

the second bearing pad has a base portion that fits around and is axially slidable on the second neck, the second bearing pad being in contact with the second thrust shoulder; and the initial gap is located between the second bearing pad and the second thrust bearing pad.

17. A method of operating an electrical submersible pump assembly having a pump, a motor, and a shaft extending along an axis from the motor into the pump, comprising:

providing a thrust bearing mechanism with first and second thrust runners axially and rotationally secured to the shaft and located in a housing, first and second thrust transferring devices non rotatably mounted in the housing between the first and second thrust runners, respectively, and first and second thrust receiving structures rigidly mounted in the housing;

providing the first thrust transfer device with an axially deflectable member;

providing the second thrust transfer device with an axial length less than an initial distance from the second thrust receiving structure to the second thrust runner, creating an axial initial gap prior to operation of the pump;

operating the pump with the motor, creating a down thrust on the shaft that passes through the first thrust transfer device and the first thrust receiving structure to the housing, the down thrust decreasing a thickness of the deflectable member;

the decrease in thickness of the deflectable member allowing the shaft and the second thrust runner to move downward, thereby closing the gap and transferring a portion of the down thrust on the shaft from the second thrust runner through the second thrust transfer device and the second thrust receiving structure to the housing; and wherein the gap closes in response to wear between the first thrust runner and the first thrust transfer device.

18. The method according to claim 17, wherein providing the deflectable member comprises providing a disc of resilient material.

* * * * *